US009482979B2

(12) United States Patent
Op de Beeck et al.

(10) Patent No.: US 9,482,979 B2
(45) Date of Patent: Nov. 1, 2016

(54) LIQUID TONER DISPERSION AND USE THEREOF

(71) Applicant: Xeikon IP BV, Eede (NL)

(72) Inventors: Werner Jozef Johan Op de Beeck, Putte (BE); Lode Erik Dries Deprez, Wachtebeke (BE); Geert Gaston Paul Deroover, Lier (BE)

(73) Assignee: Xeikon IP BV, Eede (NL)

( * ) Notice: Subject to any disclaimer, the term of this patent is extended or adjusted under 35 U.S.C. 154(b) by 31 days.

(21) Appl. No.: 14/565,021

(22) Filed: Dec. 9, 2014

(65) Prior Publication Data

US 2015/0168863 A1 Jun. 18, 2015

(30) Foreign Application Priority Data

Dec. 13, 2013 (NL) ..... 2011955

(51) Int. Cl.
*G03G 9/13* (2006.01)
*G03G 9/135* (2006.01)

(52) U.S. Cl.
CPC ..... *G03G 9/133* (2013.01); *G03G 9/135* (2013.01)

(58) Field of Classification Search
CPC ..... G03G 9/12; G03G 9/125; G03G 9/13; G03G 9/132; G03G 9/133
See application file for complete search history.

(56) References Cited

U.S. PATENT DOCUMENTS

2007/0258731 A1 11/2007 Miura et al.
2008/0131807 A1 6/2008 Teshima et al.
2012/0009516 A1* 1/2012 Ganapathiappan .... G03G 9/122 430/117.1

* cited by examiner

*Primary Examiner* — Peter Vajda
(74) *Attorney, Agent, or Firm* — The Webb Law Firm

(57) ABSTRACT

A liquid toner dispersion provided with marking particles comprising a pigment and a polyester based resin. The dispersion includes a nonpolar organic solvent and a hyperdispersant including a graft copolymer provided with an anchor group including an amine-functionalized polymer onto which at least one stabilizing group is grafted. The stabilizing group includes a hydroxylated fatty acid oligomer. The amine-functionalized polymer has a weight-average molecular weight of less than 1000 g/mol.

19 Claims, 1 Drawing Sheet

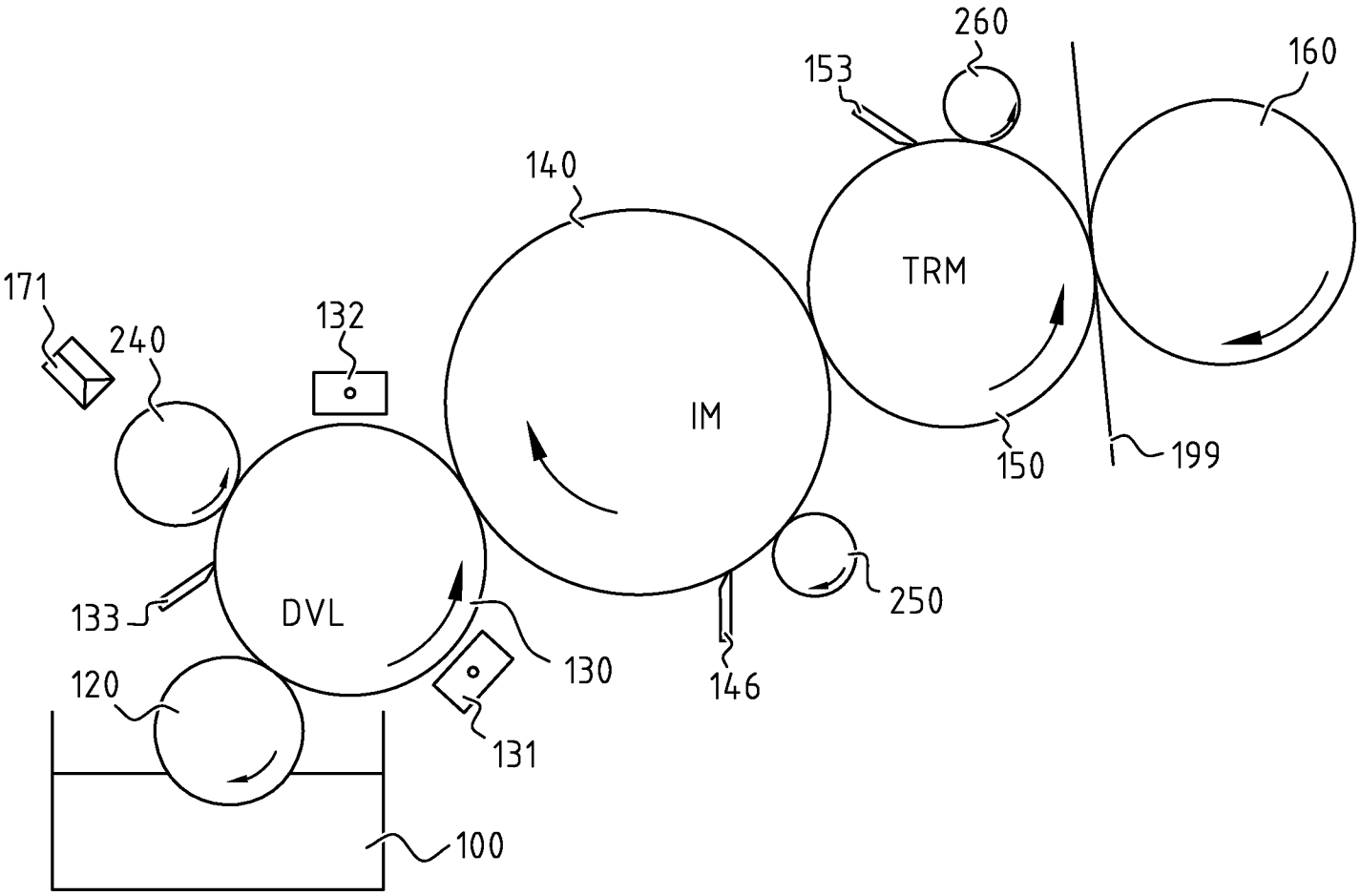
160
199
260
150
TRM
153
250
146
IM
140
130
131
100
132
DVL
240
133
120
171

LIQUID TONER DISPERSION AND USE THEREOF

CROSS-REFERENCE TO RELATED APPLICATION

This application claims priority to The Netherlands Patent Application No. 2011955 filed Dec. 13, 2013, the disclosure of which is hereby incorporated in its entirety by reference.

FIELD OF THE INVENTION

The invention relates to a liquid toner dispersion comprising a grafted copolymer of an amine-functionalised polymer onto which fatty acid compound is grafted.

The invention also relates to the preparation of such liquid toner dispersion.

The invention further relates to the use of said dispersion in a printing process.

BACKGROUND OF THE INVENTION

Liquid toner dispersion is a stabilised dispersion for use in a printing process. It differs from other ink dispersions such as dispersions for offset printing and inkjet compositions, on the basis of the particles it contains. Whereas an inkjet composition generally comprises pigment as such, the liquid toner dispersion comprises marking particles comprising pigment that is mixed with or is embedded in a polyester resin binder. The resulting particles suitably have a diameter in the range of 0.5-5.0 μm whereas the pigment particle size in inkjet and offset is below 500 nm.

In such liquid toner printing process a digital printing apparatus as described in US patent application no 2011/0249990 can be used. The liquid toner dispersion is typically transferred from feeding means, such as a feed roller to a first member via a second member to a substrate. Those members are for instance cylindrical rollers, but may have another form. The first member is also known as a development roller. The second member is also referred to as a photoconductor. Further intermediate members may be present, for instance between the photoconductor and the substrate.

One of the complexities of the liquid toner process is the stability of the liquid toner dispersion. In relation thereto, a dispersant is used. The use of hyper-dispersants seems beneficial. These hyper-dispersants comprise an anchor group and a stabilising group. The anchor group is anchored on the polymer particle surface by single-point or—typically—multipoint anchoring. Both acrylates and amines are known as anchor group. The stabilising group grafted onto the anchor group extends in non-aqueous system to provide steric stability. One specific example of a known hyper-dispersant is a graft copolymer with a polyethylene-imine (PEI) as the anchor group and poly(12-hydroxy stearic acid) as the solvent group in aliphatic hydrocarbon continuous phases. This graft copolymer of a hydroxylated fatty acid is commercially available, for instance from Lubrizol under the tradename Solsperse™. Other known hyper-dispersants are available from Tianlong Chemicals under the tradename of Tilosperse™.

The use of Solsperse™ dispersing agents are for instance disclosed in US2007/0258731A1. This application relates to the preparation of a liquid toner dispersion. Herein, toner material is milled in a fatty acid monoester, and therefore homogeneously distributed therein (par [0104]). The milled toner material is thereafter dispersed in the carrier liquid, which is an unsaturated fatty acid triglyceride (par [0038]). A dispersant is added, which is preferably a polymer dispersant, with a weight-average molecular weight of 1000 to 100,000, more preferably 5000 to 80,000 (par [0076]). The polymer dispersant is more preferably a polyamine aliphatic polycondensate, which has a weight-average molecular weight of 5000-80,000 (par [0324]). Specific examples are Solsperse™ 13940 and Solsperse™ 11200.

It has been found by the inventors of the present invention in the course of investigations in relation to liquid toner dispersions, that the stability requirements are manifold. The dispersion should evidently be stable during and after preparation, i.e. during storage and upon application to the first member. But the liquid toner process further requires that the fusing is not hindered or disturbed by the presence of the same dispersant. Moreover, the dispersion should not be sensitive to an artefact called caking, after charging the dispersion and/or discharging the dispersion and when the toner layer is mechanically stressed (e.g. when blade cleaning is performed).

In order to transfer the liquid toner dispersion from the first member to the second member, the liquid toner dispersion is typically charged. Due to this charging process, the transfer may be selective, such that merely a desired image is transferred from the first member to the second member. Charging and compaction of the liquid toner dispersion however also has an impact on the stability of the dispersion. As a consequence hereof, an issue occurs that is known as 'caking'. Particularly, polymer 'marking' particles in the dispersion tend to form lumps in the dispersion resulting in a liquid with a non-uniform distribution of marking particles. This caking often results in an increase of the viscosity of the liquid dispersion. This viscosity increase is significant, and could be a tenfold increase or even more, resulting in a more difficult liquid system to be transported. Liquid developer dispersion that shows caking cannot be used for printing as such and needs to be treated first in order to re-obtain a homogeneously dispersed liquid toner which has similar physical properties like conductivity and viscosity as the starting liquid developer dispersion. It is thought that caking is the result of marking particles that come so close into each other's neighbourhood on the developing member, so that they start to feel each other's presence and start interacting with each other. Caking can also be the result of injecting charge and applying high shearing forces which are typically present when a thin layer of liquid developer dispersion passes through a very narrow gap between two (rotating) members of the printing apparatus or huge (microsized) mechanical interaction like a cleaning blade scraping on a circular surface.

It is therefore an object of the invention to obtain a liquid toner dispersion that would meet all needs. The hyperdispersant should in particular be capable of stabilising the initial liquid toner dispersion, but it should not disturb the fusing process and it should not give rise to significant caking, at least less than the known Solsperse™ dispersants, such as Solsperse™ 11000 and Solsperse™ 13940.

SUMMARY OF THE INVENTION

According to a first aspect, this object is achieved in a liquid toner dispersion provided with marking particles comprising a pigment and a preferably a polyester based resin, said dispersion comprising a nonpolar organic solvent and a specific hyper-dispersant, i.e. a graft copolymer having an anchor group comprising an amine-functionalised polymer onto which a stabilising group is grafted, said stabilising group comprising a fatty acid compound, wherein the amine-functionalised polymer has an weight-average molecular weight of less than 1000 g/mol, and wherein the graft copolymer has a weight-average molecular weight in the range of 1500-40,000 g/mol, preferably 2000-20,000 g/mol.

According to a second aspect, the invention relates to the preparation of a liquid toner dispersion of the invention, comprising the steps of the provision of the amine functionalised polymer with a weight-average molecular weight of less than 1000 g/mol; the grafting of a hydroxylated fatty acid compound onto the amine-polymer, under formation of a hyper-dispersant, with the graft copolymer has a weight-average molecular weight in the range of 1500-40,000 g/mol, preferably 2000-20,000 g/mol and the mixing with solvent and marking particles.

According to again a further aspect, the invention relates to a method of digitally printing an liquid toner dispersion, wherein use is made of a first member that rotates and is in rotational contact with a further member during printing, which printing method comprises the steps of: (1) charging a liquid toner dispersion of the invention to facilitate transfer thereof from the first member to the further member; (2) transferring the charged liquid toner dispersion from a surface of the first member via the at least one further member to a substrate, wherein excess liquid toner dispersion remains present on the first member after said transfer, and wherein the liquid toner dispersion is heated upon transfer from a further member to the substrate, so as to achieve fusing of the ink onto the substrate, and; (3) removing, at least substantially, the excess liquid toner dispersion from the surface of the first member by means of a removal device.

The inventors have unexpectedly found, in investigations leading to the invention that these hyper-dispersants with a relatively small anchor group turn out to function well in the invention; i.e. they are able to stabilise the initial dispersion, limit or even prevent the occurrence of caking and function properly during fusing, i.e. they do not longer stabilise the dispersion at increased temperature, so that the fusing of individual particles onto the substrate is not inhibited. Herein, at least one of the stabilising groups of the hyper-dispersant is preferably sufficiently long to provide a steric effect. Several types of stabilising groups can be used. The type of chemistry will determine the affinity for the carrier liquid and the degree of steric stabilisation.

In a most preferred embodiment, at least one stabilising group is coupled to an amine-group of the anchor group so as to constitute an amide-linkage. This amide appears to contribute to the adhesion on the polymer particles which are effectively ester based. However, alternative linkages such as via an alcohol group are not excluded.

It is observed that in the context of the invention, the term 'graft copolymer' refers both to a polymer wherein a covalent amide binding is formed, and to a precursor polymer thereof, wherein the initial binding is based on a acid-base interaction whereby a positively charged amine and the negatively charged carboxylic group is formed. Such a salt interaction remains localised due to the nonpolar organic solvent of the dispersion, and therefore effectively functions as a binding. The salt interaction is the consequence of a preferred possible synthetic method, in which the salt is prepared, which is thereafter converted into a covalent binding, for instance by heat treatment. However, it is not feasible to determine to which extent the conversion of the salt binding to the covalent binding proceeds. It is not excluded that the heat treatment would be omitted or be limited, so that the binding remains—at least primarily—in the form of a salt. Moreover, it is not excluded to prepare the graft polymer of the present invention in another manner (e.g. by performing a transfer from an ester group to an amide group with the removal of the low boiling alcohol). The linkage between anchor group and stabilising group may for instance be prepared by the use of an additional linking group between the amine and the fatty acid compound. The carboxylic acid group can also be converted to a primary alcohol and then coupled to the amines.

Preferably, the weight-average molecular weight of the anchor group is less than 500 g/mol. Such small anchor group typically comprise a few repetitive units. The anchor group suitably comprises primary and secondary amine groups. It may further comprise tertiary amine groups, resulting in a branched amine-functionalised polymer. However, the amine-functionalised polymers are preferably linear amines. This turns out beneficial for the anchoring. On a microstructural level, it is believed that linear amine-functionalised polymers can adapt their conformation more easily to the microstructure of the surface of the marking particle and can direct their tails more easily towards the carrier liquid phase.

Examples of preferred amine-functionalised polymers are polyamines, for instance polyallylamines and poly(alkylene) imines, wherein the alkylene is chosen from ethylene, propylene, isopropylene, butylene, isobutylene and any other butylene isomer. The amine-functionalised polymer may further be a copolymer.

In the context of the present invention, reference is made to amine-functionalised polymers. The degree of polymerisation herein may be limited to less than 30, or even less than 20, and may even be less than 10. It goes without saying that such polymers could alternatively be referred to as oligomers.

The stabilising group is most generically a fatty acid compound. It can be derived from condensation polymerisation of hydroxylated fatty acid compounds. Suitably, the chain length of the fatty acid is in the range of C12-C24, preferably C16-C20, more preferably C18. Preferably, the stabilising group is branched, so as to improve the steric effect. Good results have been obtained with hydroxylated stearic acid, such as 12-hydroxylated stearic acid and 4-hydroxylated stearic acid, and with the unsaturated ricinoleic acid (12-hydroxy-9-cis-octadecenoic acid). These fatty acids both have a C18-chain length. Further suitable fatty acids are for instance butolic acid (6-hydroxytetradecanoic acid), convolvulinic acid (11-hydroxytetradecanoic acid), jalapinolic acid (11-hydroxyhexadecanoic acid), lesquerolic acid (14-hydroxy-eicos-cis-11-enoic acid), isoricinoleic acid (9-hydroxy-octadeca-cis-12-enoic acid), dimorphecolic acid (9-hydroxy-octadeca-trans-10, trans-12-dienoic acid), helenynolic acid (9-hydroxy-octadeca-trans-10, cis-12-dienoic acid), coriolic acid (13-hydroxy-octadeca-cis-9, trans-11-dienoic acid), auricolic acid (14-hydroxy-eicos-cis-11, cis-17-dienoic acid), ximenynolic acid (8-hydroxy-cis-11-octadecene-9-ynoic acid), isanolic acid (8-hydroxy-cis-17-octadecene-9,11-diynoic acid). The oligomers of hydroxylated fatty acids are preferred in view of their enhanced polarity relative to non-hydroxylated fatty acids.

The polymerisation degree of the stabilising group (tail) may generally vary between 1 and 12. The fatty acid compound is therewith best referred to as a monomer (n=1) or as an oligomer. Suitably, at least one of the stabilising groups has a polymerisation degree of 4-8, preferably 5-7. Such a degree of polymerisation is beneficial to obtain an appropriate steric effect, and hence, to ensure appropriate stabilisation of the initial dispersion, i.e. during storage and upon application to a first member of the printing system.

In one embodiment substantially all stabilising groups have a same degree of polymerisation. In an alternative embodiment, a first stabilising group has a first degree of polymerisation, typically in the range of 4-7 and a second stabilising group has a second degree of polymerisation that is less than the first degree, suitably 1-3.

Suitably, all the stabilising groups are built up from the same hydroxylated fatty acid. This may be practical from synthetic perspective, but it is not necessary. The fatty acid polymer may alternatively contain different fatty acids, such as both unsaturated and saturated fatty acids. Moreover, in a further embodiment, the above mentioned second stabilising group may contain a different fatty acid than the first stabilising group. The fatty acid of the second stabilising group could for instance be linear rather than branched and have a shorter chain length.

It will be understood by the skilled person that an optimum choice of the anchor groups and the stabilising groups further depends on the choice of carrier liquid (also referred to as solvent) and marking particles. The mutual compatibility of the different chemical groups from anchoring and stabilising part with marking particles and carrier liquid can be estimated on the basis of the Hansen solubility parameters, as known from Hansen Solubility Parameters in Practice, 4th Edition; Steven Abbott, Charles M. Hansen and Hiroshi Yamamoto; ISBN 978-0-9551220-2-6, and can be checked with regular experimental tests.

The use of the dispersion in a liquid toner process is believed to require a balance between adsorption to the surface of the marking particles comprising toner resin on the one hand, and desorption into the carrier liquid on the other hand. It is believed that this is also an issue of kinetics. Therefore, smaller anchoring groups are considered to work better. Furthermore, it appears beneficial that not all binding sites of the anchor groups are substituted with stabilising groups, and particularly not with stabilising groups with significant length. According to one embodiment, the degree of substitution of the anchor group with stabilising groups with significant length, for instance a degree of polymerisation of 5-8, is relatively low, for instance less than 50%. Furthermore, in the light of the desired balance between adsorption and desorption, the use of hydroxylated fatty acid compounds in combination with a suitable carrier liquid, such as a mineral oil, is preferred. Herein, the stabilising groups are more polar than the carrier liquid and thus do not show perfect matching. This is deemed preferable in order to prevent reduced adsorption of the hyper-dispersant to the marking particles.

The overall weight-average molecular weight of the graft copolymer is suitably in the range of 1500-40,000 g/mol. Preferably, the weight-average molecular weight is in the range of 2000-20,000, more preferably in the range of 2500-18000 and most preferably in the range of 2500 to 10,000 g/mol.

The liquid dispersion of the invention is preferably used in a digital printing process as described in Applicant's earlier non-pre-published patent applications EP 131625774 (improved toner removal), EP 121866768 (fusing), NL 2011067 (roller fuser sponge), which are included herein by reference.

The invention further relates to the graft copolymer as such, as discussed hereinabove and hereinafter and the use thereof for stabilisation of ink dispersions, particularly liquid toner dispersions. Particularly, the graft copolymer may be used as a hyperdispersant for selective stabilisation of a dispersion, such as a dispersion of marking particles in an organic solvent, more preferably an organic non-polar solvent, for instance a mineral oil. Due to the use of the graft copolymer, stabilisation occurs during preparation, storage and on application of the dispersion on a first member, particularly at room temperature, while the dispersion stability disappears on heating the dispersion in the course of a fusing step. Moreover, it has been found that the charging performance of the dispersion is quite stable for charging over a long period, when using a graft copolymer with an anchoring group with an weight-average molecular weight of less than 1000 g/mol, or even less than 500 g/mol and suitably at least 100 g/mol, more preferably at least 150 g/mol or at least 200 g/mol.

Suitably, the anchoring group is provided with at least 3 binding sites, typically primary or secondary amines, at which binding to the stabilising group, f.i. a hydroxylated fatty acid compound can occur. More preferably, the amount of binding sites is at least 5 per molecule. A suitable number of binding sites per anchoring group is up to 25, and clearly dependent on the molecular mass of the anchoring group. For instance, when the molar mass of the anchoring group is below 600 g/mol, the number of binding sites will be up to 15, and may even be smaller than 10.

Since the binding of the stabilising group to the binding sites is a statistical process, the number of stabilising groups bound to an anchoring group may well vary per molecule. Evidently, it is further dependent on the molar ratio between binding sites and stabilising groups. The effective, average ratio of bound stabilising groups to binding sites is the degree of substitution. The degree of substitution of the amine groups of the anchor groups may vary. Good results have been obtained with substitution degrees in the range of 10-66%. In one embodiment, the degree of substitution may be 10-50% or 12-48%. In such a situation, the degree of substitution for stabilising groups with a higher degree of polymerisation, for instance 4 or more, suitably 4-8, is preferably still in the range of 10-66%, preferably 12-48%. However, particularly if some of the substituted stabilising groups have a low degree of polymerisation, this substitution degree may even be larger than 66%.

Furthermore, the anchor group is suitably linear, and more preferably aliphatic. This is believed to be advantageous for the adhesion to marking particles. As discussed above, it is suitable that at least one stabilising group coupled to the anchor group has a polymerisation degree of 4 or more, suitably 4-8, for instance 5-7, so as to obtain a suitable steric effect. The hydroxylated fatty acid compound may be a hydroxylated fatty acid monomer, but alternatively a so-called fatty acid polymer. This is in one preferred embodiment a polyester of the hydroxylated fatty acid. More specifically, a mixture of stabilising groups is used, with at least one polymer with relatively long length, for instance a polymerisation degree of 5-7, and with a compound with a low degree of polymerisation, for instance 1 (monomer) to 3.

According to another aspect, the invention relates to a liquid toner dispersion provided with marking particles comprising a pigment and a resin, said dispersion comprising a nonpolar organic solvent and a hyper-dispersant comprising a graft copolymer provided with an anchor group comprising an amine-functionalised polymer onto which at least one stabilising group is grafted, said stabilising group comprising a fatty acid compound, wherein the copolymer contains in addition to the—first—hydroxylated fatty acid polymer species a second hydroxylated fatty acid polymer species that has a lower degree of polymerisation than the first hydroxylated fatty acid polymer species. Herein, the second hydroxylated fatty acid polymer species suitably has a molecular weight that is lower than 1200 g/mol. The first fatty acid compound species preferably has a molecular weight in the range of 1200-3500 g/mol.

In one suitable embodiment, the amine-functionalized polymer has a weight-average molecular weight of at most 1000 g/mol and more preferably at most 500 g/mol. The weight-average molecular weight of the hyper-dispersant is preferably in the range of 1500-40,000 g/mol.

As appears from the examples, a liquid dispersion with a hyper-dispersant having two stabilizing groups with different length, more particularly a different degree of polymerisation of the fatty acid polymer, have very beneficial caking properties, and good adhesion results. It was furthermore found that the increase in viscosity during the caking test was comparatively low, making that the liquid toner dispersion with such hyper-dispersant can be removed from a member, such as a development member easily.

This aspect of the invention not only relates to the liquid toner dispersion, but also to its method of preparation, its use for printing, and to the hyper-dispersant as such. Moreover, any of the embodiments discussed hereinabove with respect to any other aspect and/or recited in the claims are also deemed applicable to the present aspect.

According to again a further aspect, the invention relates to a liquid toner dispersion provided with marking particles comprising a pigment and a resin, said dispersion comprising a nonpolar organic solvent and a hyper-dispersant comprising a graft copolymer provided with an anchor group comprising an amine-functionalised polymer onto which at least one stabilising group is grafted, said stabilising group comprising a fatty acid compound, wherein the amine-functionalised polymer has 3-25 binding sites, and the degree of substitution of the binding sites is in the range of 10-66%. Suitably, the number of binding sites is less than 15 or even at most 10. The degree of substitution may be 10-50% or 12-48% or 14-35%. Suitably, the amine-functionalized polymer has a weight-average molecular weight up to 1000 g/mol. It was found that hyper-dispersants with such a low number of binding sites and an even lower number of substituted binding sites provide excellent results in terms of caking and adhesion behaviour.

This aspect of the invention not only relates to the liquid toner dispersion, but also to its method of preparation, its use for printing, and to the hyper-dispersant as such. Moreover, any of the embodiments discussed hereinabove with respect to any other aspect and/or recited in the claims are also deemed applicable to the present aspect.

BRIEF INTRODUCTION TO THE FIGURES

These and other aspects of the invention will be further elucidated with reference to the figures, wherein:

FIG. 1 is a schematic view illustrating a first embodiment of the invention.

DETAILED DESCRIPTION OF ILLUSTRATED EMBODIMENTS

The Figures are not drawn to scale and purely diagrammatical in nature. Equal reference numerals in different Figures refer to equal or corresponding features.

FIG. 1 illustrates diagrammatically a first embodiment of a digital printing apparatus of the invention, comprising a reservoir 100, a feed member 120, a developer member 130, an imaging member 140, a intermediate member 150 and a support member 160. A substrate 199 is transported between intermediate member 150 and support member 160. Both the development member 130 and the imaging member 140 and also the intermediate member 150 can function as the first member according to the invention, and are shown to be provided with a removal device 133, 146, 153, and with treatment means 132, 240; 250; 260. Without loss of generality, the aforementioned members are illustrated and described as rollers, but the skilled person understands that they can be implemented differently, e.g. as belts.

In operation, an amount of liquid developer dispersion, initially stored in a liquid developer dispersion reservoir 100, also called main reservoir, is applied via a feed member 120, to a development member 130, an imaging member 140, and an optional intermediate member 150, and finally to a substrate 199. The development member 130, imaging member 140, and intermediate member 150 all transfer part of the liquid developer dispersion 100 adhering to their surface to their successor; the part of the liquid developer dispersion 100 that remains present on the member's surface, i.e. the excess liquid developer dispersion, is removed after the transfer stage by appropriate means. The development member 130, the imaging member 140 and the intermediate member 150 may all act as the first member.

The charging of the toner on the development roll is done by charging device 131. This charging device can be a corona or a biased roll. By charging the toner the liquid developer dispersion splits into an inner layer at the surface adjacent of the development member 130 and an outer layer. The inner layer is richer in marking particles (also referred to as toner particles) and the outer layer is richer in carrier liquid. The transition between these two layers may be gradual.

Upon transfer of the liquid developer dispersion from the development member 130 to the imaging member 140, excess liquid developer dispersion is left on the development member 130. Ideally, this excess liquid developer dispersion is present only in "non-image" areas, i.e. areas not corresponding to the image to be printed on the substrate, which is specified by the imaging member. However, it is not excluded that a thin layer remains on the development roller 130 at the area of the transferred image. The physicochemical state and the rheology of the excess liquid developer dispersion are influenced by the charging and also by the concentration of the toner particles, which may have changed i.e. increased due to loss of carrier liquid during the development step. More particularly, in one suitable embodiment, the excess liquid developer dispersion is more concentrated and shows caking. This transformation is due to the charging and to the transfer of part of the outer layer that is richer in carrier liquid.

FIG. 1 further shows a discharging corona 132 that is provided downstream of the area of the rotational contact between the developer roller 130 and the imaging roller 140. The discharging corona 132 is suitable for changing/removing the charge in the dispersion. Further, downstream of the discharge corona 132 there is provided an additional member 240. In this example, the additional member is embodied as a loosening roller, which is provided with a rubbing portion. This is useful for improvement of mixing of the excess liquid developer dispersion with the added agent or with pure carrier liquid as such in order to reduce the concentration of the compacted developer solution. The agent can be one or more dispersing agents.

As shown in this example, but that is not deemed essential, the agent or pure carrier liquid may be applied in a pattern-wise manner via application means 171. Such application means 171 may be inkjet printing heads and other disposal means for patterned application of a liquid. In the shown example, the spacer agent may be added to the excess liquid dispersion, pattern wise via the application means 171 and the loosening roller 240. The loosening roller 240 is, in use, in rotational contact with the development member 130. Similar loosening rollers 250, 260, which could be simply addition rollers without a dedicated rubbing portion, are present in rotational contact with the imaging member 140 and the intermediate member 150 respectively. Thereafter, a removal device is present, which most suitably is a scraper 133. The removed material is preferably recycled into fresh liquid toner.

Investigations have shown that several steps in the printing process are sensitive for failure, which may lead to errors in the image printed on the substrate, or to malfunctioning of the printing process.

A first sensitive step is the charging step 131. Marking particles in the dispersion are aligned herein due to the charging and/or the presence of an electric field typically applied at the nip between the first member and the further member, f.i. the developer member 130 and the imaging member 140. Without a proper charging and alignment, the patterned transfer from the first member to the further member will not be adequate.

A second sensitive step is the removal of the liquid toner residue that remains on the first member, such as the development roller 130, but alternatively the imaging member 140 or the intermediate member 150. As discussed above, marking particles in the liquid developer dispersion tend to form lumps in the dispersion resulting in a liquid with a non-uniform distribution of marking particles. This is called caking and often results in an increase of the viscosity of the liquid dispersion and partial jelly fractions of ink. This viscosity increase is significant and could be a tenfold increase or even more. The removal of the liquid toner residue starts then to be problematic. As a result, liquid toner residue could remain on the development roller, which constitutes a contamination and may lead to a non-uniform distribution of fresh developer dispersion resulting in a ghost image and or image quality that is not perfect, in other words incorrect. Examples of issues are density instability and incorrect reproduction of fine lines.

A third sensitive step is the fusing of the liquid toner. This fusing is to result in coalescence of the marking particles on the paper. Typically use is made of a heat treatment that takes place shortly before, during or shortly after the transfer of the dispersion to the substrate. The term 'coalescence' refers herein to the process wherein marking particles melt and form a film or continuous phase that adheres well to the substrate and that is separated from any carrier liquid. Suitably, the carrier liquid is thereafter removed in a separate step, for instance by means of rollers, by means of blowing off the carrier liquid, by means of suction. Suitably, this process occurs at "high speed", for instance 50 cm/s or more, so as to enable high-speed printing. When the dispersion stability is very good at elevated temperatures, ultimately an emulsion can be formed, the coalescence is prevented leading to an inadequate fusing. Other means for fusing can also be used where the most of carrier liquid phase is removed by for example evaporation on a transfuse belt or by a semi-permeable belt. This has the advantage that almost no carrier liquid is left over during final fusing step favouring the coalescence of the marking particles.

In order to solve the caking issue, mechanical and chemical means may be used to clean the surface of the first member 130. The use of chemical means is however relatively limited, because the removed material is suitably recycled into fresh toner. Typically, no additives are allowed which would contaminate the fresh toner and thus have an impact on the printing process and/or the quality of the printed image.

In order to arrive at an improved printing process, the dispersion is a key element, and a difficult one. Modification of the dispersion typically influences its behaviour during charging, transfer and fusing. Modification of the dispersion also may have an impact on the behaviour of the liquid toner residue. Particularly, a dispersion that becomes unstable and inhomogeneous can give rise to a tremendous change in the rheology: a homogeneous dispersion mostly flows in its entirely, but the rheology of an inhomogeneous dispersion is in fact dependent on the two separate phases in the dispersion (the dispersed phase and the dispersing phase). In other words, the behaviour of a dispersion that becomes inhomogeneous is highly complex, and its flow behaviour is rather unpredictable without significant (experimental) investigation, possibly leading to unexpected stand stills of the ink liquid.

In this invention, when is referred to a concentration of "liquid developer dispersion" it refers to a concentration wherein the liquid developer dispersion has a solid content so that it can be used as such in a digital printing process. In other words, the liquid developer dispersion according to the invention has a solid content that is at working strength and does not require a dilution. A typical solid content of liquid developer dispersion is a solid content of between 10 to 30 wt %, such as a solid content of 25 wt %. According to this invention, "solid content" means the amount of marking particles in wt % with regard to the total liquid developer dispersion. According to this invention, "excess liquid developer dispersion" is the liquid developer dispersion that remains present on the surface of a member, such as the developing member, after a part of liquid developer dispersion has been transferred to another member, such as the imaging member.

In the context of the present invention, the liquid toner is a dispersion of marking particles in a carrier liquid. The marking particles, according to this invention, comprise coloured particles (also called ink particles or pigment) and a binder resin, although non-pigmented resin systems also can be used containing a phosphor or taggant or UV active material. Typically, the diameter of the marking particles is about 0.5 to 4.0 μm. The marking particles have a concentration of about 40-95% of binder resin. The binder resin is a polymer, preferably transparent, that embeds the ink particles. Preferably, a polyester resin is used as binder resin. Also other types of resin having a very low or no compatibility with the carrier liquid and dispersing agent can be used. Preferably, the resin has a high transparency, provides good colour developing properties and has a high fixing property on the substrate. The carrier liquid according to the invention can be any suitable liquid as is known in the art, and may be silicone fluids, hydrocarbon liquids and vegetable oils, or any combination thereof. The resin further can contain plasticisers or other material that can adjust the meltviscosity and Tg of the resin system. The toner also can contain compounds to adjust or increase the charging and transfer characteristics of the toner particle during print.

In the liquid developer dispersion of the invention, the pigment is typically melt mixed with possible other ingredients like non carrier liquid soluble waxes, plasticisers, and the binder resin into a pre-dispersion typically by extrusion and treated to provide suitably dimensions, for instance by dry milling. The binder resin is most suitably a polyester, which includes, in the context of the present invention, a polymer comprising ester functionality, such as a polyester copolymer. The dispersing agent, carrier liquid and marking particles are mixed into the liquid pre-dispersion, which is thereafter further processed, for instance by fluid milling, like bead milling.

The concentration of toner particles (solid content) in excess liquid developer dispersion will vary depending on the amount of marking particles that needs to be developed. The two most extreme situations of developing are that all the liquid developer dispersion is developed (100% page coverage), or none of the liquid developer dispersion is developed (0% page coverage). The latter results in a substrate without printed image of that colour. When no liquid developer dispersion is developed and all the marking particles remain on the developing member and thus reside in the excess liquid developer dispersion, the solid content is higher than in the liquid developer dispersion, particularly due to the partial removal of the carrier liquid containing some dispersing agent in the non-image areas. On the contrary, if all the liquid developer dispersion is developed, the excess liquid developer dispersion remaining on the developer roller will comprise almost no marking particles resulting in an excess liquid developer dispersion that mainly comprises carrier liquid containing also some dispersing agent. A person skilled in the art will understand that the solid content and the concentration of the carrier liquid in the excess liquid developer dispersion will vary between these two extremes depending on what needs to be developed. Typically, during the printing process a certain amount of carrier liquid is lost because it is highly unlikely that one prints continuously 100% page coverage all the time for all colours. Typically, the viscosity of the excess liquid developing dispersion is increased compared to the viscosity of the starting, i.e. 'fresh' liquid developing dispersion. The increase of the viscosity is due to the loss of carrier liquid and dispersing agent and due to caking. Caking causes a structural change in the liquid developing dispersion and has a significant contribution to the increase of viscosity of the excess liquid developer dispersion.

Example 1

Synthesis of Polyhydroxystearic Acid (PHSA)

In a 1 L flask equipped with a Dean-Stark apparatus and a reflux condenser, there are added 400 g of 12-hydroxyoctadecanoic acid (12-hydroxystearic acid), 1 ml titanium (IV) butoxide and 120 ml xylene. The reaction mixture is heated under nitrogen in an oil bath at 200° C., and refluxed for 30 h. The progress of the reaction can be monitored by the amount of separated water. The degree of condensation was determined by means of IR and titration. In the IR spectrum the carbonyl stretch ratio of the carboxylic acid and the ester is a measure of the degree of condensation. By means of titration, the acid value can be determined. In this example, 20 mg KOH/g was obtained, which is a value of 8 or 10 HSA (m=6-8) units and a Mw of 2800 g/mol.

Poly(hydroxystearic acid) with another degree of polymerisation and other fatty acid polymers may be prepared in analogue manner. Generally, as mentioned before, the compound may be present in a degree of polymerisation of 1 (monomer) preferably up to 10. Suitably, the stabilising groups used for the preparation of the dispersing agent comprise at least fatty acid compound with a degree of polymerisation of 4 or higher. Furthermore, while in the used example, the hydroxylated fatty acid is a saturated fatty acid, more particularly stearic acid, it could alternatively be an unsaturated fatty acid or any other saturated fatty acid with a group capable of bonding with the acid group. Thus while hydroxylated fatty acids are most preferred, amino-substituted fatty acids are not excluded. Furthermore, the hydroxyl-function is present in this example in the centre of the monomer. The centre is here any position between atom 4 and 15 on the fatty acid chain, in this example at carbon atom 12. Preferably, the side chain defined in the repetitive unit has a length of at least C3, more preferably at least C4, such as butyl, pentyl, hexyl, heptyl or octyl. It is not excluded that the fatty acid chain itself is branched and that the resulting repetitive unit has a first and a second side chain.

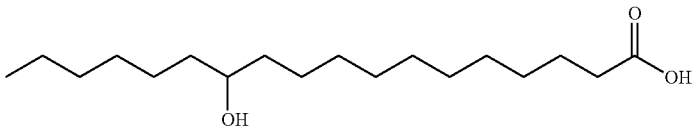

12-hydroxy octadecanoic acid
12-hydroxy stearic acid

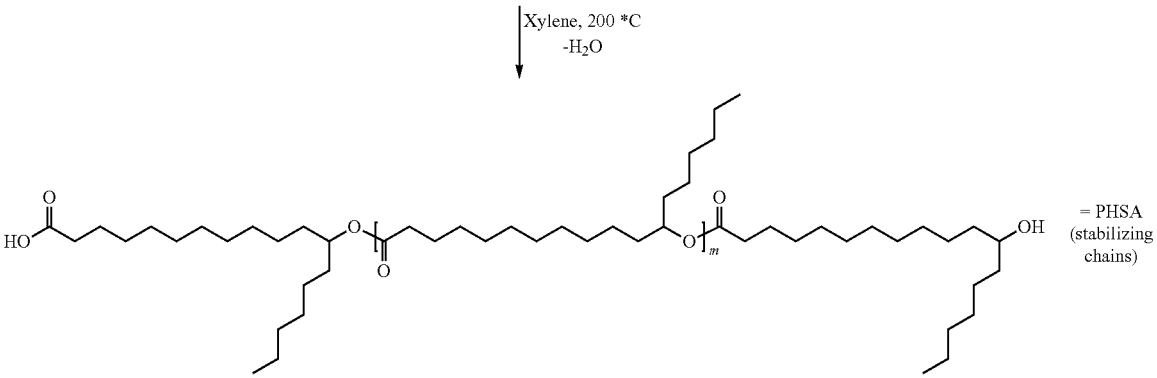

Example 2

Coupling of Polyethylenimine (PEI) with 12-Hydroxystearic Acid (PHSA)

10 g pentaethylenehexamine was heated with 120.5 g PHSA (Mw 2800) under a nitrogen flow for 6 hours at 150° C. After cooling, an oily substance is obtained that can be used as such.

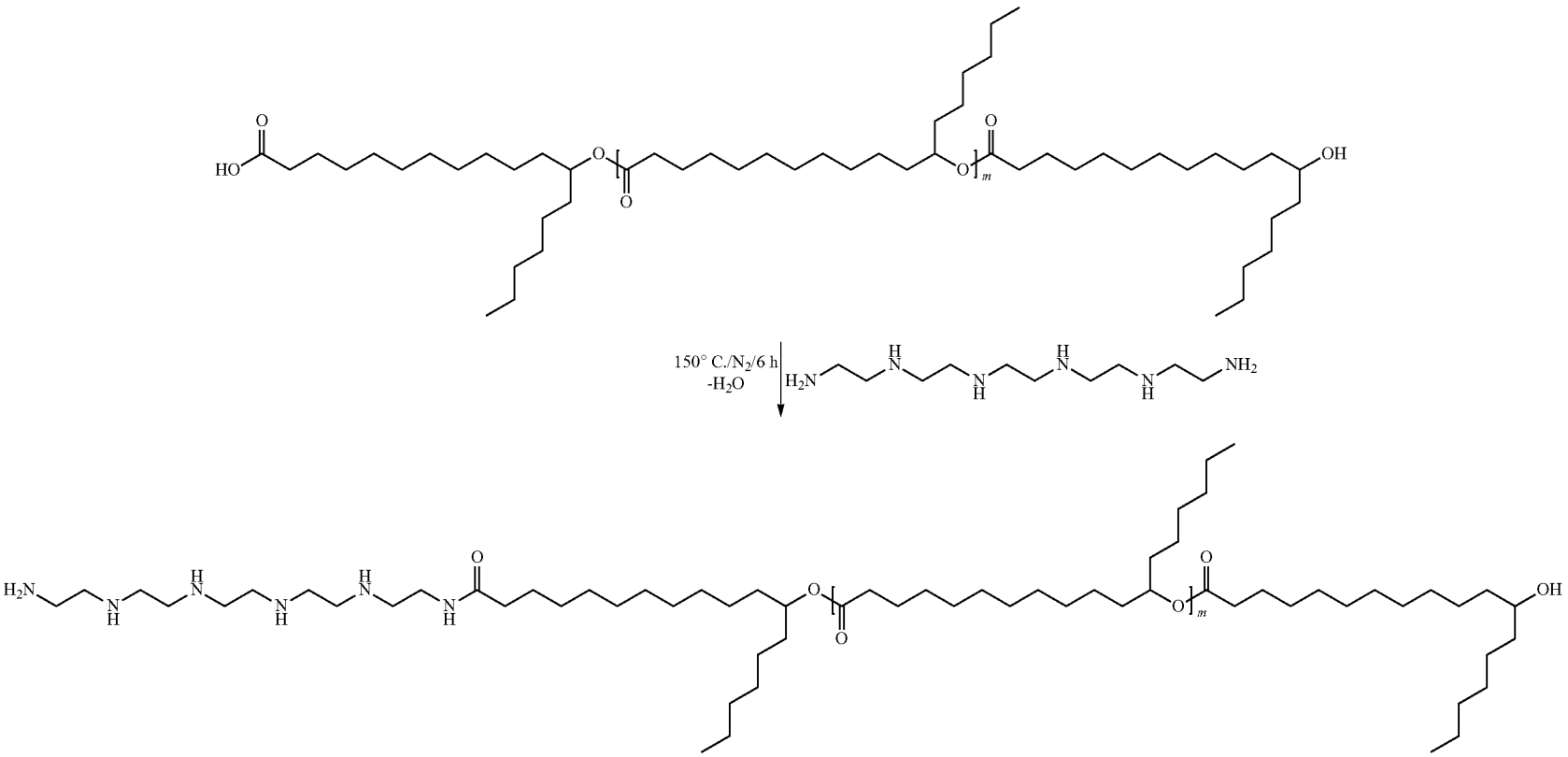
150° C./N2/6 h
-H2O

The dispersing agents mentioned in table 2 were prepared according the above method according to the composition as mentioned in table 2.

Examples with the Liquid Toner Dispersion

Various tests have been carried out in accordance with the invention.

Test Methods

Viscosity

The viscosity of the liquid developer dispersion and carrier liquid is measured with a Haake Rheostress RS6000 operated in shear rate sweep from 0.1 to 3000 l/s at 25° C. The instrument is equipped with a cone/plate geometry type C60/1° and the gap is set to 0.052 mm. The viscosity is measured, on the basis of the operation in shear rate sweep, at a value of 0.88 l/s. The measurements are carried out at the beginning and after the caking test and at room temperature. The time lapsed in the caking test is sufficient to ensure a representative measurement.

Adhesion Test

The adhesion is a measure for the fusing degree and is measured by a tape test. A tape type Scotch Magic tape 19 mm of length 15 cm is put on the fused image and removed slowly under an angle of 90 to 150° C. The tape is visually inspected and the adhesion is ranked as follows 1: no toner left on the tape: OK.

2: almost no toner left on the tape: acceptable.

3: clear deposition of toner on the tape and/or almost no toner anymore on printed samples—unacceptable.

Caking

As there are no standard measurement tools for caking as encountered in a liquid toner process, i.e. a liquid toner electro-photographic process, a test system was built consisting of a simplified version of the apparatus described in FIG. 1. The system comprises a liquid developer dispersion reservoir, a toner supply roller, a development roller, a thickening corona for toner compaction on the development roller and a polyurethane scraper blade to remove excess developer from the development roller. As the test system has no photoconductor, all toner applied to the development member is considered excess toner. Hence this test system makes it possible to perform worst-case caking experiments.

An anilox roll with a volume of 14 $cm^3/m^2$ was used as a toner supply roller. The development roller was made of rubber, which is a silicone rubber with a hardness 50 shore A. The test system was operated at 60 cm/s and the thickening corona was operated at 4 kV.

The caking level is evaluated by visual inspection of the toner on the scraper blade after a 2 hour test and ranked as follows:

0 refers to no caking, meaning that a very good result is obtained.

1, 2, or 3 refers to caking levels where small acceptable amounts of caking occurs, where 1 refers to a good result, 2 refers to a moderate result, and 3 refers to a result that is just acceptable.

4 refers to a caking level that is not acceptable.

5 refers to severe caking.

Examples

Several liquid developer dispersions are prepared and comprise a marking particle, a carrier liquid and a dispersing agent. A marking particle was prepared by kneading a polyester resin with pigment. The ingredients used to prepare the marking particles and the liquid developer dispersions are summarised in table 1.

The marking particles are prepared by kneading the ingredient as mentioned in table 1 at a temperature of 100 to 120° C. for 45 minutes. This mixture is cooled down and milled down to 10 μm by a fluidised bed mill

TABLE 1 composition of marking particles

| name | Polymer name | conc (w/w %) | Pigment Name | conc (w/w %) | Additive name | conc (w/w %) |
|---|---|---|---|---|---|---|
| MAR1 | PM1 | 87.5 | PIG1 | 12.5 | | |
| MAR2 | PM1 | 81.5 | PIG1 | 12.5 | AD1 | 6 |

PM1 = polyester resin Tg = 60° C. and Tm = 100° C. and acid value of 12 mg KOH/gr
PIG1 = copper phthalocyanine PB15:3 (Heligen blau D7079)
AD1 = toluenesulfonamide additive Afterwards the liquid developer dispersions are prepared as mentioned in table 3 based on the dispersing agents as mentioned in table 2.

A pre-dispersion of the ingredients is made and stirred for 10 minutes at room temperature. The pre-dispersion is than brought into a bead mill to prepare the liquid developer dispersion. The liquid developer dispersions were milled down to a dv50 of 1.8 to 2. The milling was done until the desired particle size, viscosity and conductivity was obtained.

TABLE 2 dispersing agents

| DA | base equivalent (1) | PA MW (2) | type PA | tail MW (2) | type tail | MW DA (2) |
|---|---|---|---|---|---|---|
| sols13940 (3) | 520-660 | | | | | |
| sols11000(3) | 1300-1700 | | | | | |
| DA1 | | 10000 | PEI | 1600 | PHSA | 65000 |
| DA2 | | 800 | PEI | 560 | PHSA | 3200 |
| DA3 | | 230 | PEI | 1600 | PHSA | 2000 |
| DA4 | | 800 | PEI | 1600 | PHSA | 7500 |
| DA5 | | 800 | PEI | 2800 | PHSA | 5500 |
| DA6 | | 230 | PEI | 2300/ 300 (4) | PHSA | 4000 |
| DA7 | | 230 | PEI | 1900 | PHOA | 3500 |
| DA8 | | 230 | PEI | 2800 | PHSA | 3000 |

PA = polyamine
DA = dispersing agent
MW = molecular weight
PEI = polyethyleneimine
PHSA = polyhydroxystearic acid
PHOA = polyhydroxyricinoleic acid
(1) the amount of dispersing agent that is needed to neutralise 1 mol of acid.
(2) weight-average molecular weight.
(3) polymeric dispersant in aliphatic distillate from Lubrizol Ltd.
(4) Stabilising part contains 2 different molecular weights: one part has MW = 2300 other has MW = 300.

TABLE 3 liquid developer dispersion composition

| | marking particles | | dispersing agent | | carrier liquid (1) |
|---|---|---|---|---|---|
| name | name | conc (w/w %) | | conc (w/w %) | conc (w/w %) |
| LD1 | MAR2 | 35 | Solsperse 13940 | 3.5 | 61.5 |
| LD2 | MAR2 | 35 | Solsperse 11000 | 3.5 | 61.5 |

TABLE 3-continued

| liquid developer dispersion composition | | | | | |
|---|---|---|---|---|---|
| | marking particles | | dispersing agent | | carrier liquid (1) |
| name | name | conc (w/w %) | | conc (w/w %) | conc (w/w %) |
| LD3 | MAR2 | 35 | DA1 | 5 | 60 |
| LD4 | MAR2 | 35 | DA2 | 3.8 | 61.2 |
| LD5 | MAR2 | 35 | DA3 | 3.25 | 61.75 |
| LD6 | MAR1 | 35 | DA4 | 3 | 62 |
| LD7 | MAR1 | 35 | DA5 | 3 | 62 |
| LD8 | MAR1 | 35 | DA6 | 5 | 60 |
| LD9 | MAR2 | 35 | DA7 | 3.25 | 61.75 |
| LD10 | MAR2 | 40 | DA8 | 4 | 56 |

(1) mineral oil with a viscosity at 25° C. of 6 mPas

With the liquid developer dispersion LD1 to LD10 caking tests were performed and images were print by diluting LD1 to LD10 to a solid content of 25%. The images were printed with an optical density from 1.4 to 1.6 with an engine as described in EP12175762 at a speed of 60 m/min. The fusing step 170 was modified in such a way that the electrostatically transferred image from the intermediate roller 150 to the substrate is fed to a fusing station which contains a non contact infrared zone to accomplish to coalescence of the liquid developer dispersion and the adhesion to the substrate and after the infrared zone 3 heated rollers pairs are located to possible adjust the adhesion and gloss and to collect the separated carrier liquid for reuse to perform the dilution of the concentrated liquid developer to the desired printing concentration. On the heated rollers a scraper is mounted to collect the separated carrier liquid.

The infrared heater was equipped with ceramic tiles (Elstein type) to emit IR. The temperature of the tiles was adjusted to obtain a substrate temperature between 100 and 120° C.

The heated rollers were operating between 110 and 130° C.

The substrate was a 120 gsm coated paper from UPM.

TABLE 4

| results | | | | | | |
|---|---|---|---|---|---|---|
| toner | DA | viscosity (1) | viscosity (2) | caking (3) | tapetest | type |
| LD1 | sols13940 | 90 | 1400 | 5 | 1 | Comparative |
| LD2 | sols11000 | 45 | 1200 | 4 | 3 | Comparative |
| LD3 | DA1 | 75 | 1375 | 5 | 2 | Comparative |
| LD4 | DA2 | 95 | 970 | 3 | 1 | Invention |
| LD5 | DA3 | 67 | 846 | 2 | 2 | Invention |
| LD6 | DA4 | 90 | 786 | 3 | 2 | Invention |
| LD7 | DA5 | 120 | 803 | 2 | 2 | Invention |
| LD8 | DA6 | 143 | 575 | 1 | 2 | Invention |
| LD9 | DA7 | 98 | 727 | 2 | 2 | Invention |
| LD10 | DA8 | 175 | 622 | 1 | 2 | Invention |

(1) measured at shear rate of 0.88 1/s at start of the caking test at 25° C.

(2) measured at shear rate of 0.88 1/s at end of the caking test (after 2 hours), measured at 25° C.

(3) visual observation of caking at end of the caking test.

From the results it is clear that only the liquid developer dispersions (LD4 to LD10) that have a polyamine anchoring part with a MW lower than 1000 g/mol have a good caking behaviour and fusing property. Particularly good results have been obtained with the liquid toner dispersions having an anchoring group with a molecular weight of less than 500 g/mol, and more preferably having an overall molecular weight (weight-average) of 2000-5000, more preferably 2500-5000 (examples LD8-10).

In summary, the present invention relates to a new dispersing agent and liquid toner dispersions therewith. The dispersing agent is of the hyper-dispersant type and suitable for adhesion to a particle surface. It is typically added to the dispersion after that the particles have been prepared, for instance prior to a milling step of the particles. The dispersing agent comprises an anchoring group to which one or more several stabilising groups are bound. The binding may occur at binding sites of the anchoring group, preferably in the form of primary or secondary amines, though tertiary amines are not excluded as potential binding sites. The binding is in the form of a salt or a covalent binding, under formation of an amide. The anchoring group has a molar mass of at most 1000 g/mol, most preferably at most 500 g/mol. Suitably, the number of binding sites is at least 3, or for larger molecules at least 6. The degree of substitution of stabilising groups onto the binding sites is typically 10-66%, preferably 12-48%. The stabilising groups can be built up from hydroxylated fatty acid monomers. One suitable class has the alcoholic group halfway the monomer, for instance between position 8 and 14 relative to the carboxylic group, so that the oligomer has side chains. Such a branching turns out beneficial for steric properties, and the dispersing in the carrier liquid, typically a substantially non-polar compound. Long stabilising groups for instance have a degree of polymerisation of at least 4, for instance 4-10. As a result, the weight-average molecular weight of the dispersing agent is suitably in the range of 1500-40000, more preferably 2000-20,000 g/mol.

The dispersing agents of the invention have beneficial properties for use in a printing process wherein liquid dispersion is used, and thus transferred from a development member to an imaging member in accordance with a latent image on the imaging member and particularly after a charging pre-treatment, such as a corona treatment, and from the imaging member to a substrate, particularly in a process wherein fusing is carried out on the substrate. Critical issues herein are caking on the development member of excess liquid dispersion not transferred to the imaging member, and adhesion to the substrate in the course of fusing. These processes are described in more detail in Applicant's applications PCT/NL2014/050425 and PCT/NL2014/050600 that are incorporated herein by reference.

The invention claimed is:

1. A liquid toner dispersion provided with marking particles comprising a pigment and a resin, said dispersion comprising a nonpolar organic solvent and a hyper-dispersant comprising a graft copolymer provided with an anchor group comprising an amine-functionalised polymer, wherein the amine-functionalised polymer has 3-25 binding sites in the form of nitrogen atoms, onto which at least one stabilising group is grafted, wherein the amine-functionalised polymer has an weight-average molecular weight of in the range of 100-1000 g/mol, wherein said stabilising group comprises an oligomer of hydroxylated fatty acids, of which a carboxylic acid group is coupled to a binding site of the amine-functionalised polymer and wherein the graft copolymer has a weight-average molecular weight in the range of 1500-40,000 g/mol.

2. The liquid toner dispersion of claim 1, wherein the graft copolymer has a weight-average molecular weight in the range of 2000-20,000 g/mol.

3. The liquid toner dispersion as claimed in claim 1, wherein the at least one stabilising group is coupled to an amine-group of the anchor group so as to constitute an amide-linkage.

4. The liquid toner dispersion as claimed in claim 1, wherein the amine-functionalised polymer has a weight-average molecular weight of less than 500 g/mol.

5. The liquid toner dispersion as claimed in claim 1, wherein the amine-functionalised copolymer is linear.

6. The liquid toner dispersion as claimed in claim 1, wherein the amine-functionalised polymer is chosen from the group of polyethyleneimine and polyallylamine.

7. The liquid toner dispersion as claimed in claim 1, wherein the amine-functionalised polymer has a degree of polymerisation of at most 20.

8. The liquid toner dispersion as claimed in claim 7, wherein the amine-functionalised polymer has a degree of polymerisation in the range of 5-10.

9. The liquid toner dispersion as claimed in claim 1, wherein at least one of the fatty acid compound species grafted as a stabilising group has a molecular weight in the range of 1200-3500 g/mol.

10. The liquid toner dispersion as claimed in claim 9, wherein the copolymer contains in addition to the hydroxylated fatty acid oligomer a hydroxylated fatty acid species with a molecular weight that is lower than 1200 g/mol, wherein a carboxylic group of the hydroxylated fatty acid species is coupled to a binding site of the amine-functionalized polymer.

11. The liquid toner dispersion as claimed in claim 1, wherein the degree of substitution of the binding sites is in the range of 10-66%.

12. The liquid toner dispersion as claimed in claim 11, wherein the degree of substitution of the binding sites is in the range of 10-50%.

13. A method of preparing a liquid toner dispersion comprising the steps of:

preparing an amine functionalised polymer with a weight-average molecular weight in the range of 100-1000 g/mol, said amine functionalized polymer having 3-25 binding sites in the form of nitrogen atoms;

grafting an oligomer of hydroxylated fatty acids onto the amine-functionalised polymer, therewith obtaining a hyper-dispersant, wherein a carboxylic acid group of said oligomer is coupled to a binding site of the amine-functionalized polymer, wherein the graft copolymer has a weight-average molecular weight in the range of 1500-40,000 g/mol; and mixing the hyper-dispersant with a nonpolar organic solvent and marking particles.

14. The method as claimed in claim 13, wherein the grafting comprises a first step, wherein a salt of the hydroxylated fatty acid oligomer and the amine-functionalised polymer is formed, and a second step, wherein the salt is converted into the polymer.

15. The method as claimed in claim 14, wherein the conversion of the salt is incomplete.

16. A method of digitally printing a liquid toner dispersion, wherein use is made of a first member that rotates and is in rotational contact with a further member during printing, which printing method comprises the steps of:

charging a liquid toner dispersion as claimed in claim 1 to facilitate transfer thereof from the first member to the further member;

transferring the charged liquid toner dispersion from a surface of the first member via the at least one further member to a substrate, wherein excess liquid toner dispersion remains present on the first member after said transfer, and wherein the liquid toner dispersion is fused to obtain a fused film on the substrate, and;

removing, at least substantially, the excess liquid toner dispersion from the surface of the first member by means of a removal device.

17. The liquid toner dispersion as claimed in claim 1, wherein the graft copolymer has a weight-average molecular weight in the range of 2500-10,000 g/mol.

18. The liquid toner dispersion as claimed in claim 10, wherein the second hydroxylated fatty acid species has a degree of polymerisation of 1-3.

19. The liquid toner dispersion as claimed in claim 1, wherein the oligomer of hydroxylated fatty acids is based on a hydroxylated fatty acid monomer with a chain length of 12-24.

* * * * *